United States Patent [19]

Palac

[11] 4,100,451

[45] Jul. 11, 1978

[54] FACE PANEL ASSEMBLY FOR A COLOR CATHODE RAY TUBE

[75] Inventor: Kazimir Palac, Carpentersville, Ill.

[73] Assignee: Zenith Radio Corporation, Glenview, Ill.

[21] Appl. No.: 675,653

[22] Filed: Apr. 12, 1976

Related U.S. Application Data

[63] Continuation of Ser. No. 498,836, Aug. 19, 1974, which is a continuation of Ser. No. 285,985, Sep. 5, 1972.

[51] Int. Cl.[2] ..... H01J 29/07; H01J 31/20

[52] U.S. Cl. ..... 313/404; 313/406

[58] Field of Search ..... 313/402–408

[56] References Cited

U.S. PATENT DOCUMENTS

| | | | |
|---|---|---|---|
| 2,222,197 | 11/1940 | Engels | 313/481 X |
| 2,562,163 | 7/1951 | Hiensch et al. | 313/482 X |
| 2,733,366 | 1/1956 | Grimm et al. | 313/408 X |
| 2,824,990 | 2/1958 | Haas | 313/402 |
| 2,906,904 | 9/1959 | Woughter et al. | 313/402 |
| 2,916,644 | 12/1959 | Kautz et al. | 313/402 |
| 2,922,063 | 1/1960 | Haas | 313/406 |
| 2,961,560 | 11/1960 | Fyler | 313/408 X |
| 3,350,593 | 10/1967 | Lindeman et al. | 313/402 |
| 3,358,170 | 12/1967 | Fiore | 313/404 X |
| 3,404,302 | 10/1968 | Nicklas | 313/402 |
| 3,529,199 | 9/1970 | Duistermaat et al. | 313/404 |
| 3,548,235 | 12/1970 | Driedijk et al. | 313/404 |
| 3,601,650 | 8/1971 | Pappadis | 313/404 |
| 3,639,799 | 2/1972 | Kirchner | 313/402 |
| 3,700,949 | 10/1972 | Watanabe et al. | 313/405 |
| 3,735,179 | 5/1973 | Kaplan | 313/406 X |
| 3,943,399 | 3/1976 | Sedivy | 313/404 |

FOREIGN PATENT DOCUMENTS

| | | | |
|---|---|---|---|
| 1,278,633 | 6/1972 | United Kingdom | 313/402 |
| 1,278,634 | 6/1972 | United Kingdom | 313/402 |
| 1,278,635 | 6/1972 | United Kingdom | 313/402 |

*Primary Examiner*—Robert Segal

*Attorney, Agent, or Firm*—John H. Coult

[57] ABSTRACT

This disclosure depicts, in a color cathode ray tube, the combination comprising an approximately rectangular, flangeless, curved faceplate supporting on a concave inner surface thereof in a central region a phosphor screen comprising a pattern of red-emissive, blue-emissive and green-emissive phosphor triads. A low mass, approximately rectangular, non-self-rigid shadow mask has a central portion with a pattern of electron-transmissive apertures registered with the pattern of phosphor triads. The mask has a rim portion providing substantial rigidity with respect to axes normal to the sides thereof while providing for flexure of the mask with respect to its diagonals. A mask suspension system for establishing a predetermined position of the mask relative to and at a predetermined spacing from the inner surface of the faceplate includes four suspension means for mechanically coupling the mask directly to corner portions of the faceplate. The suspension means are located one at each corner of the mask to permit the mask to flex about its diagonals and conform to the contour of the faceplate despite any twist-wise deformation thereof, thereby maintaining said predetermined spacing between the mask and the faceplate inner surface.

23 Claims, 11 Drawing Figures

FIG. 4
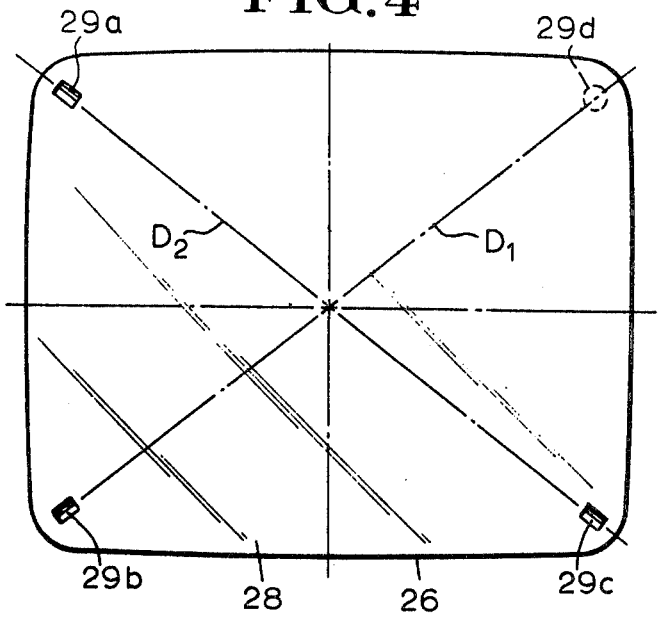
FIG. 5
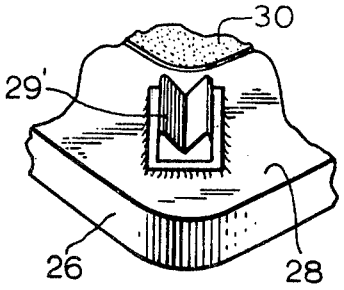
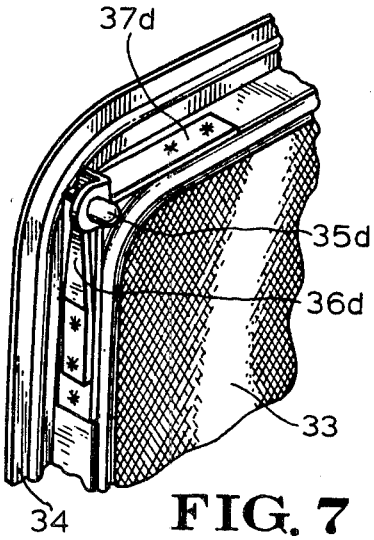
FIG. 7
FIG. 6
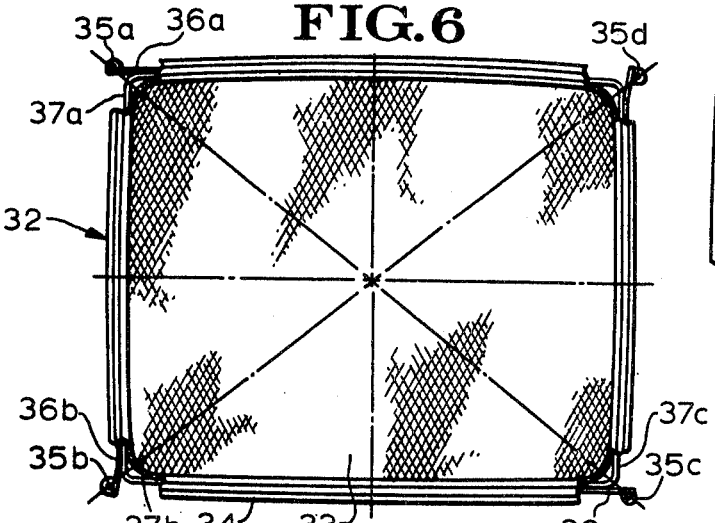
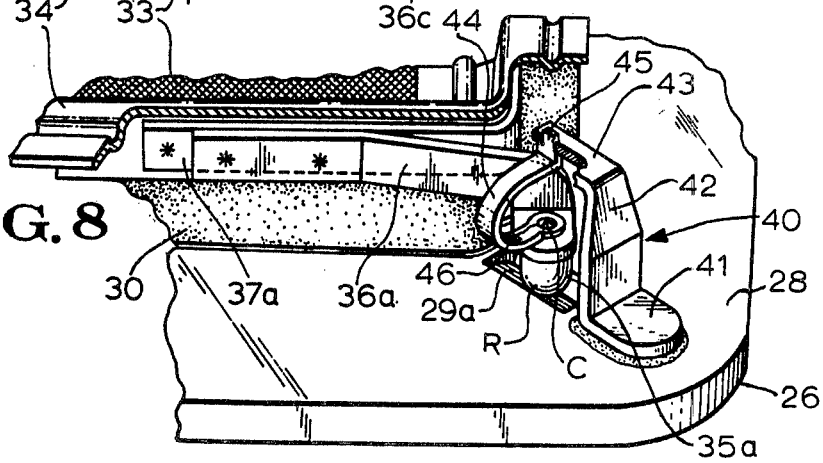
FIG. 8

FACE PANEL ASSEMBLY FOR A COLOR CATHODE RAY TUBE

CROSS-REFERENCE TO RELATED APPLICATION

This application is a continuation of application Ser. No. 498,836, filed Aug. 19, 1974 which is, in turn, a continuation of application Ser. No. 285,985, filed Sept. 5, 1972, assigned to the assignee of the present application.

BACKGROUND OF THE INVENTION

This invention relates in general to color reproducing cathode ray tubes and in particular to a face panel arrangement for use in such tubes.

The conventional mass produced color picture tube employed in most present day color television receivers comprises a glass funnel, having a neck portion which houses electron beam generators, and a glass face panel comprising a curved target surface upon which a luminescent screen formed of a multitude of phosphor triads is deposited. In addition to the target surface the face panel comprises an integrally formed rearwardly extending flange that circumscribes the target surface. This flange is provided with three or more mounting studs that serve to support a color selection electrode, which usually takes the form of an aperture mask.

In order for the electron beams to achieve proper color selection the apertures in the mask must individually effect registration with assigned ones of the phosphor triads comprising the luminescent screen. Effecting and maintaining such registration in prior art picture tubes is achieved by resort to a massive, and thus costly, mounting arrangement for the aperture mask. To this end the mask is welded to a relatively heavy gauge steel frame which serves to support the mask as well as to impart rigidity to it. This frame is provided with three or more mounting clips each of which has one end secured to the frame while the other end is provided with an opening or other provision for engaging an assigned one of the studs affixed to the flange of the face panel. The above-described face panel and mask assembly, which comprises a unit of substantial mass, is then affixed to the funnel portion of the envelope by means of a frit seal.

In addition to the problems encountered in handling the frame and mask subassembly and, thereafter, the mask and face panel assembly, the use of a flanged face panel represents a significant cost. This obtains because of glass design considerations necessarily entailed, due to the flange, in producing a face panel having the requisite integrity. By the same token, the mask frame itself is also an item which contributes to the overall cost of the assembly.

The actual weight of the mask and its frame are also of consequence as respects another consideration, that is, the G forces to which a color picture tube is unavoidably subjected. More particularly, when a picture tube is jarred or vibrated the G forces which the mask and frame subassembly apply to the mounting studs affixed to the face panel flange are considerable in view of the weight of the frame. When these forces are substantial they can cause deformation of the frame and/or the mounting clips which, in turn, effect a misregistration between the apertures of the mask and their assigned phosphor triads. In some instances the G forces to which the tube is subjected may be sufficient to cause the shadow mask and its frame to fracture or even dislodge one of the mounting studs on the flange of the face panel.

In view of the foregoing, it is apparent that a reduction in the overall weight of the aperture mask mounting frame, as well as the face panel, is most desirable. While efforts have been expended to achieve a lighter weight mask-frame subassembly, the results, for the most part, simply amounted to a reduction in the mass of the mounting frame. While this approach has produced a lighter mask subassembly, the improvement is substantially one of degree only and has not been accompanied by any significant improvement in the mask mounting arrangement or in the overall cost of a face panel assembly.

It is therefore an object of the invention to provide a face panel assembly for use in a color picture tube which represents an improvement over prior art face panel assemblies by its compactness, low mass, economy of manufacture, and simplicity and by its use of a color selection electrode which has low mass and a capability of conforming to its supporting faceplate.

State of the Art:

| | | | | |
|---|---|---|---|---|
| 2,222,197 | 2,906,904 | 3,350,593 | 3,548,235 | British |
| 2,562,163 | 2,916,644 | 3,358,170 | 3,601,650 | 1,278,633 |
| 2,733,366 | 2,922,063 | 3,404,302 | 3,639,799 | 1,278,634 |
| 2,824,990 | 2,961,560 | 3,529,199 | 3,700,949 | 1,278,635 |
| | | | 3,735,179 | |

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompany drawings, in the several figures of which like reference numerals identify like elements and in which:

FIG. 4 is a plan view of the faceplate shown in FIG. 3;

FIG. 5 is a fragmentary perspective view of an alternate construction for the indexing station shown in FIGS. 3A and 3B;

FIG. 6 is a plan view of the aperture mask shown in FIG. 3;

FIG. 7 is a fragmentary perspective view of one corner of the mask shown in FIG. 6, as viewed from the faceplate side; and FIG. 8 is a perspective view of a mounting clamp for releasably securing the aperture mask of FIG. 6 to the faceplate shown in FIG. 4.

DESCRIPTION OF THE PREFERRED EMBODIMENT

Figure 1:
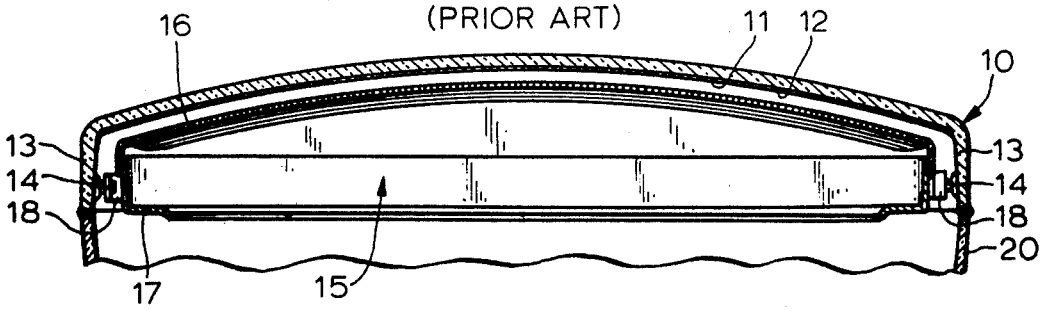
FIG. 1 (PRIOR ART)
FIG. 1 is a sectional view of the face panel portion of a prior art color picture tube.

The face panel and shadow mask assembly sectionally illustrated in FIG. 1 is representative of the prior art construction and to this end comprises a dished face panel 10 having a curved target surface 11 upon which a luminescent screen 12 is deposited. A flange 13, which circumscribes the target surface and extends rearwardly therefrom, is provided with a plurality of mounting studs 14 which protrude from the inside wall of the flange. While only two studs are shown in FIG. 1, ordinarily three or four are employed. A shadow mask subassembly 15 comprises an apertured mask 16 which is welded or otherwise fastened to a mounting frame 17. This frame is provided with a plurality of mounting clips 18 each of which has one extremity secured to the flange. The other end of each of the clips is apertured to accommodate an assigned one of the mounting studs 14 protruding from the inside wall of face panel flange 13. Frame member 17 is formed of a relatively heavy gauge steel, commonly five to 10 times thicker than the aperture mask, so that the mask and frame subassembly constitutes a rigid and relatively massive structure. The face panel and mask assembly is joined to a glass funnel section 20, as by a conventional frit seal, to form the envelope portion of a color tube. Note in FIG. 1 that the flange 13, which is typical of prior art face panel construction, unavoidably adds a significant dimension to the overall length of the tube.

Figure 2:
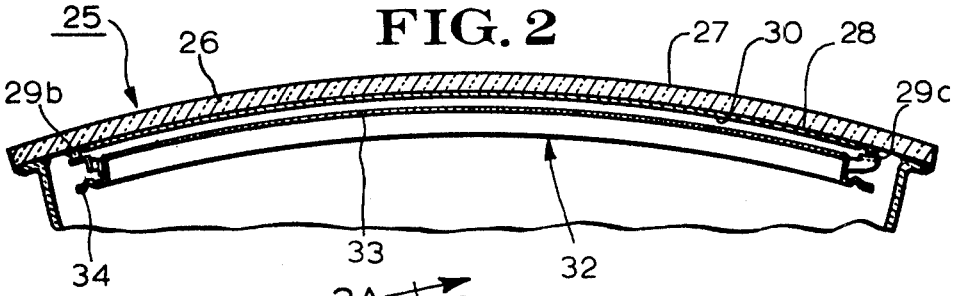
FIG. 2 is a sectional view of the face panel portion of a color picture tube constructed in accordance with the invention.
Figure 3:
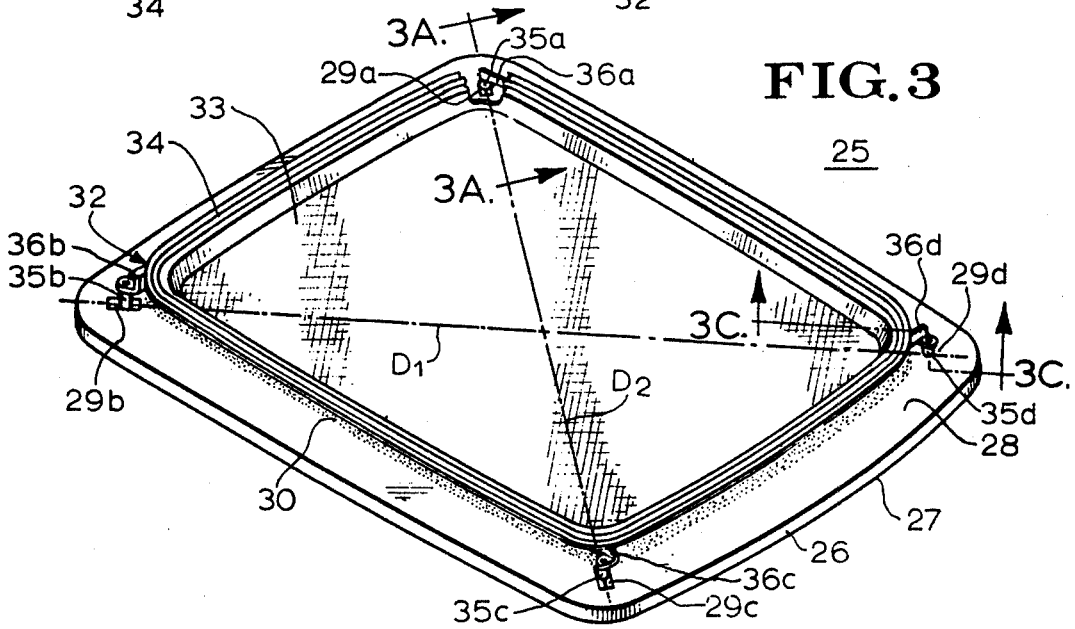
FIG. 3 is a perspective view of the face panel arrangement employed in the picture tube shown in FIG. 2.

Turning now to FIGS. 2 and 3, the assembly 25 therein depicted, which exemplifies a face panel arrangement constructed in accordance with the invention, comprises a generally rectangular flangeless curved faceplate 26. This faceplate has a convex viewing surface 27, a concave target surface 28 and, as shown in FIG. 3, a plurality of indexing stations 29*a*, 29*b*, 29*c* and 29*d* disposed about the periphery of the concave surface. Preferably, these stations are arranged so that one is located at or near each corner of the concave surface and with oppositely disposed stations lying along diagonals passing through the geometric center of the faceplate, see FIG. 4. As shown in FIGS. 2 and 3, a luminescent screen 30 comprised of a field of phosphor triads is deposited on concave surface 28.

A generally rectangular color selection electrode or shadow mask 32 comprises a pliant color selection portion 33 having a curvature approximately that of faceplate 26 and, preferably, an integrally formed rim portion 34 that circumscribes pliant portion 33. Preferably, pliant portion 33 adopts the form of a partially transparent mask comprising a field of apertures which individually bear a predetermined relationship to assigned ones of the phosphor triads forming luminescent screen 30. In practice, this relationship is established by virture of the fact that the mask is actually utilized in the process through which the phosphor triads are applied to concave surface 28. Rim 34 serves to prevent flexure of the mask about axes normal to the sides or edges of the mask while permitting flexure of the mask about the diagonal axes D1 and D2 extending from the corners of the electrode through its geometric center. Accordingly, electrode 32 comprises a frameless shadow mask characterized by a flexability that permits it to conform or follow a faceplate to which it is referenced, all in a manner to be described.

Figure 3A:
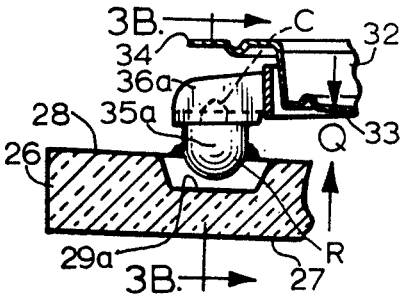
FIG. 3A is a fragmentary sectional view taken along line 3A—3A in FIG. 3.
Figure 3B:
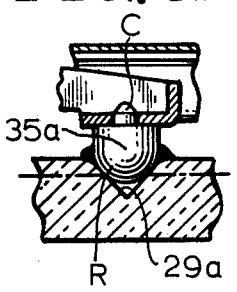
FIG. 3B is a fragmentary section view taken along line 3B—3B in FIG. 3A.

Turning now to a detailed consideration of the indexing stations disposed about the periphery of concave surface 28, stations 29*a*–29*c* comprise substantially identical V-shaped cavities or slots which are formed in surface 28, preferably when the faceplate is molded. Details of one such cavity are shown in FIGS. 3A and 3B. Alternatively, each cavity can comprise a V-block 29′, see FIG. 5, affixed to the concave surface 28 of the faceplate subsequent to the plate molding operation. It is also appreciated that the V-slots can be formed by milling or grinding surface 28, again subsequent to the molding operation. In any event, oppositely disposed ones of the V-slots are arranged with their longitudinal dimensions disposed along diagonals extending through the geometric center of the faceplate. Indexing station 29*d*, on the other hand, simply comprises a predetermined area on concave surface 28, see FIG. 3C. If desired, station 29*d* can comprise a flat formed on surface 28 during the original molding of the faceplate or it too can be developed subsequently by grinding or milling operation.

Figure 3C:
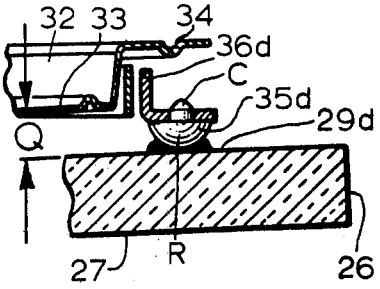
FIG. 3C is a fragmentary sectional view taken along line 3C—3C in FIG. 3.

A corresponding plurality of mounting elements 35*a*–35*d*, which are affixed to the periphery of the color selection electrode, specifically to rim 34, see FIG. 6, cooperate with assigned ones of the indexing stations on concave surface 28 in the manner shown in FIG. 3. These elements take the form of legs each having a rounded portion R for engaging its assigned indexing station and a crown C at the opposite end which cooperates with a spring biased clamping arrangement which is described below. Mounting elements 35*a*–35*d* are secured to respective ones of arms 36*a*–36*d*, one of which is detailed in FIG. 7. These arms are welded to L-shaped brackets 37*a*–37*d* which, in turn, are welded to the corners of mask rim 34. As shown in FIGS. 3A and 3C, leg 35*a* engages indexing cavity 29*a* while leg 35*d* abuts against that portion of surface 28 designated index station 29*d*. It is to be noted that legs 35*a*–35*c*, that is, the ones that engage indexing cavities are of equal length while leg 35*d* is shorter. The reason for such dimensioning will soon be made apparent.

Since it is contemplated that mask 32 will be employed in the process for applying the luminescent screen 30 to concave surface 11, it is necessary to provide means for releasably securing mask 32 on the faceplate. To this end a clamp 40 is associated with each indexing station. More particularly, and with reference to FIG. 8, a representative one of these clamps comprises a foot 41 which can be cemented, fritted or otherwise anchored to concave surface 28 of the faceplate adjacent an assigned indexing slot, for example, slot 29*a*. Clamp 40 further comprises an upright portion 42 which is terminated by an apertured offset 43. The releasable clamp further includes a U-shaped leaf spring 44 which has a dimple 45 at one end that is received by the aperture in offset 43. The other end of the spring is provided with a bore 46 which captivates the crown C of the mask mounting leg 35*a* associated therewith. In this fashion each of the mounting legs of mask 32 is releasably seated on its assigned indexing station so that the mask can be readily removed and repositioned as required during the screen forming process. In this approach to a releasable mount, clamps 40 can also serve as the means for permanently securing the mask to the faceplate upon completion of the screening operation.

Still another approach to releasably clamping the mask to the faceplate contemplates combining the V-block 29′ version of an indexing station (FIG. 5) with clamp 40. More particularly, V-block 29′ can be secured to or made a part of foot 41 of the clamp, which foot is then cemented to concave surface 28. In such an arrangement three clamps, each having a V-block affixed to its foot would constitute combination mask indexing and clamping means for stations 29*a*–29*c*. The fourth station would then simply utilize the structure of FIG. 8 for clamping leg 35*d* against area 29*d* of concave surface 28.

The manner in which the mounting legs and the indexing stations cooperate to provide a properly indexed and registered mask and faceplate assembly, which registration is substantially maintained in spite of twists or deformations occurring in the faceplate subsequent to such assembly, will now be described. To this end it is important that the mounting elements be affixed to the rim of the aperture mask in a precise manner so that the free extremities of legs 35*a* –35*c* lie in a plane that is substantially parallel to a plane extending through the four corners of the mask when the mask is resting on a flat surface. As is apparent in FIG. 3C leg 35*d* is necessarily shorter than legs 35*a*–35*c* since leg 35*d* bears against the top side of surface 28 when the other legs are nested in their assigned indexing slots, compare FIGS. 3A and 3C. It follows then that the overall effective length of leg 35*d* should be less than that of any of legs 35*a*–35*c* by an amount equal to the distance that the bottom of the rounded extremity R of leg 35*a*, for example, extends below concave surface 28 when it is nested in slot 29*a*.

The realization of a properly indexed and registered mask and faceplate assembly is achieved by the cooperation between mounting elements 35*a*–35*d* and their respective indexing stations 29*a*–29*d*. Three of the mounting elements, namely legs 35*a*–35*c*, are selected to orient mask 32 relative to faceplate 26, as well as to support it, while the fourth leg 35*d* serves principally as a support. More particularly, the rounded or balled extremities of legs 35*a*–35*c*, by virtue of their low frictional contact with their assigned V-slots, readily permit the mask to seek out an equilibrium position relative to the faceplate. Since the ball end of each leg makes a two-point contact in its assigned V-slot, a six point contact system is established which provides absolute geometric positioning of the mask. Leg 35*d*, which at this juncture can be considered a "floating" element, is free to skate across concave surface 28 and thus accompany the mask to the equilibrium position dictated by legs 35*a*–35*c* and indexing slots 29*a*–29*c*. The inherent redundancy of the four-point corner suspension system is thus compensated. However, if for one reason or another, the curvatures of the faceplate and the mask do not match then it is the function of mounting legs 35*a*–35*d* to establish a Q spacing, that is, the spacing between the mask and the concave surface of the faceplate, such that the curvature of the mask substantially complies with that of the faceplate. This compliance is achieved by virtue of the fact that the apertured pliant portion 33 of the mask is flexible about its diagonal axes D1 and D2. Thus mounting legs 35*b* and 35*d* can compensate for irregularity in faceplate curvature by flexing the mask about axis D2 while legs 35*a* and 35*c* can accomplish any required compensation by flexing the mask about axis D1. In this fashion the mask is permitted to follow the curvature of the faceplate and, as a result, a proper Q spacing and mask-faceplate registration is achieved.

Accordingly, by virtue of the above-described six-point geometric positioning of the mask on the concave surface of the faceplate, the Q spacing, as well as the registration between the field of mask apertures and the field of phosphor triads, will always be repeated exactly each time the mask is positioned upon the faceplate indexing stations. This reseatability feature of the disclosed system is extremely important, for example, when resorting to photographic techniques for applying a luminescent screen to the faceplate. In such a process the mask must be removed from the faceplate after the initial exposure and then reseated again for each subsequent exposure. Since techniques for developing a luminescent screen upon a faceplate are well known and since that, in itself, forms no part of the invention, the manner in which the screen is developed will not be detailed herein.

Subsequent to the screening operation, the faceplate and mask are ready to be united. The legs of the mask are again reseated upon their indexing stations and then secured thereto. While a variety of anchoring arrangements are available, a preferred approach contemplates the application of frit material across the rounded ends of the mounting legs and their associated indexing stations as shown in FIGS. 3A–3C, for example. In this fashion the mask is permanently bonded to the faceplate in its equilibrium position. Thereafter, should the faceplate twist or distort, the pliant nature of the mask, in conjunction with the described mounting and indexing system, will permit the mask to follow or conform to the faceplate and thus preserve registration between the mask apertures and their associated phosphor triads. This preservation of registration is achieved, as above noted, by virtue of the permitted flexure of the mask in either of two modes, that is, about diagonal axes D1 and D2. Finally, the screened faceplate and mask assembly of FIG. 3 is then joined to a funnel, as shown in FIG. 2, by a conventional fritting technique.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. For use in a color cathode ray tube, the combination comprising: an approximately rectangular, flangeless, curved faceplate supporting on a concave inner surface thereof in a central region a phosphor screen comprising a pattern of red-emissive, blue-emissive and green-emissive phosphor triads, said faceplate being subject, due to its flangeless rectangular construction to twist-wise deformations in configuration which may occur with respect to diagonals of the faceplate;

a low mass, approximately rectangular, non-self-rigid shadow mask having a central portion which has a curvature related to that of said faceplate inner surface and which contains a pattern of electron-transmissive apertures registered with said pattern of phosphor triads, said mask having a rim portion providing substantial rigidity with respect to axes normal to the sides thereof while providing for flexure of the mask with respect to its diagonals; and a mask suspension system for establishing an absolute position of said mask relative to and at a predetermined spacing from said inner surface of said faceplate while effectively imparting the rigidity of the faceplate to the non-self-rigid mask, comprising four suspension means for mechanically coupling said mask directly to corner portions of said concave inner surface of said faceplate which extend outwardly beyond the phosphor screen, said suspension means being located one at each corner of the mask to permit the mask to flex about said diagonals and conform to the contour of the faceplate despite any twist-wise deformation thereof and to thereby maintain said predetermined spacing between said mask and said faceplate inner surface.

2. The apparatus defined by claim 1 wherein said mask is frameless and wherein said rim portion includes as an integral part thereof a skirt extending radially outwardly from said central portion.

3. The combination defined by claim 1 wherein each of said suspension means includes a bracket secured to the rim portion of said mask so as to extend around a corner on the outside and in the plane thereof, to which bracket is secured cantilevered means serving to mechanically link said bracket to said faceplate.

4. The combination defined by claim 1 wherein each of at least three of said suspension means includes indexing means on said faceplate inner surface in a corner region thereof and means on a corner of said rim portion of said mask for making retentive engagement with said indexing means.

5. The combination defined by claim 1 wherein each of at least three of said suspension means includes mask locating means integral with said faceplate inner surface which defines two tangentially spaced engagement surface areas, said mask having in each of three corner portions associated with said three suspension means, corner-located means for making tangentially retentive, two-point engagement with said two tangentially spaced engagement surface areas, the resultant six-point engagement of said three corner-located means with said integral mask locating means effecting a tangentially rigid and precise coupling of said mask to said faceplate when said tube is assembled.

6. The combination defined by claim 5 wherein said three mask suspension means are located on the mask diagonals, and wherein said two points of engagement in each suspension means are located on opposite sides of a mask diagonal.

7. The combination defined by claim 5 wherein said integral mask locating means are radially oriented and are located on a faceplate diagonal, and wherein said combination includes means for immovably holding at least three of said mask corners on said faceplate.

8. The combination defined by claim 7 wherein said means for immovably holding said mask corners on said faceplate comprises cement.

9. The combination defined by claim 1 wherein at least three of said mask suspension means each include a suspension element fixedly coupled to the outside of said rim portion of said mask at an off-corner location, said element extending in the plane of said mask to the diagonal intersecting the nearest corner and having provision at the distal end thereof for retentively engaging a provision on said faceplate.

10. The apparatus defined by claim 8 wherein said mask is frameless and wherein said rim portion includes as an integral part thereof a skirt extending radially outwardly from said central portion.

11. For use in a color cathode ray tube, the combination comprising:

an approximately rectangular faceplate supporting on a concave inner surface thereof in a central region a phosphor screen comprising a pattern of red-emissive, blue-emissive and green-emissive phosphor triads;

a lightweight, approximately rectangular, frameless shadow mask having a central portion which has a curvature related to that of said faceplate inner surface and which contains a pattern of electron-transmissive apertures registered with said pattern of phosphor triads, said mask having a shallow rim portion formed integrally in said mask around said central portion and having as a part thereof a skirt extending radially outwardly with respect to said central portion, said rim portion providing substantial rigidity with respect to axes normal to the sides thereof, but providing for flexure of the mask with respect to its diagonals; and a mask suspension system for establishing a predetermined geometric position of said mask relative to and at a predetermined spacing from said inner surface of said faceplate, comprising four suspension means for mechanically coupling said mask to said faceplate, each of said suspension means including a bracket secured to the rim portion of said mask so as to extend around a corner on the outside and in the plane thereof, to which bracket is secured cantilevered means serving to mechanically link said bracket to said faceplate, said suspension means being located one at each corner of the mask to permit the mask to flex about said diagonals and conform to the contour of the faceplate, three of said four suspension means effecting a tangentially rigid, low friction, precisely reseatable coupling to said faceplate, the fourth suspension means providing for the fourth mask corner to seek an equilibrium position in a plane parallel to the faceplate, said system thereby compensating for the inherent redundancy of the four-point suspension system.

12. In a color cathode ray tube, the combination comprising:

an approximately rectangular faceplate having a concave inner surface supporting in a central, bombarded region thereof a phosphor screen comprising a pattern of red-emissive, blue-emissive and green-emissive phosphor triads;

a lightweight, approximately rectangular shadow mask having a central portion with a curvature related to that of said faceplate and having a pattern of electron-transmissive apertures registered with said pattern of phosphor triads, said mask including a circumscribing portion around said central portion providing substantial rigidity with respect to axes normal to the sides thereof, but providing for flexure of the mask with respect to its diagonals; and a mask suspension system for supporting the mask at a predetermined spacing from said inner surface of said faceplate, comprising four suspension means for mechanically coupling said mask to said faceplate, said suspension means being located one at each corner of the mask to permit the mask to flex about its diagonals so as to conform to the contour of said inner surface of the faceplate, at least three of said suspension means including a bracket secured to the circumscribing portion of said mask so as to extend around a corner on the outside and in the plane thereof, to which bracket is secured arm means serving as a mechanical link between said bracket and said faceplate.

13. In a color cathode ray tube, the combination comprising:

an approximately rectangular, flangeless, curved faceplate having a concave inner surface supporting in a central region thereof a phosphor screen comprising a pattern of red-emissive, blue-emissive and green-emissive phosphor triads, said faceplate being subject, due to its flangeless rectangular configuration, to twist-wise deformations in configuration which may occur with respect to its diagonals;

a lightweight, approximately rectangular, non-self-rigid shadow mask having a central portion which has a curvature related to the curvature and said faceplate inner surface and which contains a pattern of electron-transmissive apertures registered with said pattern of phosphor triads, said mask having a rim portion around said central portion providing substantial rigidity with respect to axes normal to the sides thereof, but providing for flexure of the mask with respect to its diagonals; and a mask suspension system for establishing a predetermined geometric position of said mask relative to and at a predetermined spacing from said inner surface of said faceplate, comprising four suspension means for mechanically coupling said mask directly to an area of the faceplate which extends outwardly beyond the phosphor screen, said suspension means being located one at each corner of the mask and on the diagonals thereof to permit the mask to flex about said diagonals and conform to the contour of the faceplate despite any twist-wise deformation thereof and to thereby maintain said predetermined spacing between said mask and said faceplate inner surface, at least three of said suspension means each including a mask element extending from a corner of said mask toward said faceplate and a radially oriented integral modification of said faceplate inner surface which receives and is secured to said mask element, said mask element including a bracket secured to said rim portion of the mask so as to extend around a corner on the outside and in the plane thereof, to which bracket is secured arm means serving to mechanically link said bracket to said faceplate.

14. For use in a color reproducing cathode ray tube, the combination comprising:

an approximately rectangular, flangeless curved faceplate having a concave inner surface on which is disposed a pattern of phosphor triads, said faceplate being subject, due to its flangeless rectangular configuration, to twist-wise deformations in configuration which may occur with respect to diagonals of the faceplate;

an approximately rectangular, low mass shadow mask comprising a color selection portion having a curvature approximating that of said inner surface of said faceplate and having a pattern of apertures registered with said pattern of phosphor triads, and further comprising a rim portion circumscribing said mask portion for stiffening the mask with respect to axes normal to the sides of the mask, while permitting said mask to flex about its diagonals; and mask suspension means in each corner region of the faceplate for mechanically coupling said mask to said faceplate, each of at least three of said mask suspension means including indexing means on said concave inner surface of the faceplate, and in at least three corresponding corner regions of said mask, mask mounting elements in registry with said indexing means for making a low friction, precise engagement with assigned ones of said indexing means, said mounting elements engaging said indexing means when said mask and said faceplate are assembled to establish a predetermined position of said mask relative to said faceplate and to establish an equilibrium condition between said mask and said faceplate, said mask flexing about its diagonals when mounted on said faceplate, if necessary, so as to conform to the configuration of said faceplate and to follow any twist-wise deformation thereof, and thereby to maintain a prescribed spacing between said mask and said faceplate inner surface.

15. The combination defined in claim 14 wherein said suspension means includes means for securing said mounting elements to their assigned indexing means.

16. The combination defined by claim 15 in which said means for securing said mounting elements to said indexing means comprises a bonding material.

17. The combination defined by claim 14 in which said indexing means comprise V-shaped grooves in said concave surface of said faceplate and said mounting elements each include a rounded extremity which engages and is cemented in said grooves.

18. For use in a color cathode ray tube, the combination comprising:

an approximately rectangular, curved faceplate supporting on a concave inner surface thereof in a central region a phosphor screen comprising a pattern of red-emissive, blue-emissive and green-emissive phosphor triads;

a lightweight, approximately rectangular, frameless shadow mask having a central portion which has a curvature related to that of said faceplate inner surface and which has a pattern of electron-transmissive apertures registered with said pattern of phosphor triads, said mask having a shallow rim portion formed integrally in said mask around said central portion and having as a part thereof a skirt extending radially outwardly with respect to said central portion, said rim portion providing substantial rigidity with respect to axes normal to the sides thereof, but providing for flexure of the mask with respect to its diagonals; and a mask suspension system for establishing a predetermined position of said mask relative to and at a predetermined spacing from said inner surface of said faceplate, comprising four suspension means for mechanically coupling said mask to said faceplate, said suspension means being located one at each corner of the mask to permit the mask to flex about said diagonals and conform to the contour of the faceplate, three of said four suspension means effecting a tangentially rigid, low friction, precisely reseatable coupling to said faceplate, the fourth suspension means providing for the fourth mask corner to seek an equilibrium position in a plane parallel to the faceplate, said system thereby compensating for the inherent redundancy of the four-point suspension system.

19. In a color cathode ray tube, the combination comprising:

an approximately rectangular, flangeless, curved faceplate having a concave inner surface supporting in a central region thereof a phosphor screen comprising a pattern of red-emissive, blue-emissive and green-emissive phosphor triads;

a lightweight, approximately rectangular, non-self-rigid shadow mask having a central portion which has a curvature related to the curvature and said faceplate inner surface and which contains a pattern of electron-transmissive apertures registered with said pattern of phosphor triads, said mask having a rim portion around said central portion providing substantial rigidity with respect to axes normal to the sides thereof, but providing for flexure of the mask with respect to its diagonals; and a mask suspension system for establishing a predetermined position of said mask relative to and at a predetermined spacing from said inner surface of said faceplate, comprising four suspension means for mechanically coupling said mask directly to an area of the faceplate which extends outwardly beyond the phosphor screen, said suspension means being located one at each corner of the mask and on the diagonals thereof to permit the mask to flex about said diagonals and conform to the contour of the faceplate despite any twist-wise deformation thereof and to thereby maintain said predetermined spacing between said mask and said faceplate inner surface, at least three of said suspension means each including mask locating means integral with said faceplate inner surface which defines two tangentially spaced engagement surface areas, one on each side of a mask diagonal, said mask having in each of three corner portions associated with said three suspension means, corner-located means for making tangentially retentive, two-point engagement with said two tangentially spaced engagement surface areas, the resultant six-point engagement of said three corner-located means with said integral mask locating means effecting a tangentially rigid and precise coupling of said mask to said faceplate, said combination including means for immovably holding said four mask corners on said faceplate when said tube is assembled.

20. The combination defined by claim 19 wherein said means for immovably holding said four corners comprises cement.

21. The combination defined by claim 20 wherein one of said corner locating means on said faceplate and said corner-located means on said mask has a "V"-shaped configuration and the other a rounded configuration for making said two-point engagement.

22. In a color cathode ray tube, the combination comprising:

an approximately rectangular, curved faceplate having a concave inner surface supporting in a central region thereof a phosphor screen comprising a pattern of red-emissive, blue-emissive and green-emissive phosphor triads, said faceplate being flangeless and thereby susceptible to twist-wise deviations in its configuration;

a lightweight, approximately rectangular, frameless shadow mask having a central portion with a curvature related to that of said faceplate and containing a pattern of electron-transmissive apertures registered with said pattern of phosphor triads, said mask including a circumscribing portion formed intergrally in said mask around said central portion and having as a part thereof a skirt extending radially outwardly with respect to said central portion, said circumscribing portion providing substantial rigidity with respect to axes normal to the sides thereof while providing for flexure of the mask with respect to its diagonals; and a mask suspension system for supporting the mask at a predetermined spacing from said inner surface of said faceplate comprising four suspension means, one at each corner of the mask, for mechanically coupling said mask directly to said faceplate.

23. For use in a color cathode ray tube, the combination comprising: an approximately rectangular, flangeless, curved faceplate supporting on a concave inner surface thereof in a central region a phosphor screen comprising a pattern of red-emissive, blue-emissive and green-emissive phosphor triads, said faceplate being subject, due to its flangeless rectangular configuration, to twist-wise deformations in configurations which may occur with respect to diagonals of the faceplate;

a low mass, approximately rectangular, frameless, non-self-rigid shadow mask having a central portion which has a curvature related to that of said faceplate inner surface and which contains a pattern of electron-transmissive apertures registered with said pattern of phosphor triads, said mask having a rim portion providing substantial rigidity with respect to axes normal to the sides thereof while providing for flexure of the mask with respect to its diagonals, said rim portion including as an integral part thereof a radially outwardly extending skirt; and a mask suspension system for supporting and positioning said mask relative to and at a predetermined spacing from said inner surface of said faceplate while effectively imparting the rigidity of the faceplate to the non-self-rigid mask, comprising four suspension means for mechanically coupling said mask directly to a corner portion of said concave inner surface of said faceplate which extends outwardly beyond the phosphor screen, said suspension means being located one at each corner of the mask to permit the mask flex about said diagonals and conform to the contour of the faceplate despite any twist-wise deformation thereof and to thereby maintain said predetermined spacing between said mask and said faceplate inner surface, each of at least three of said suspension means including mask locating means integral with said faceplate inner surface which defines two tangentially spaced engagement surface areas, said mask having in each of three corner portions associated with said three suspension means, corner-located means for making tangentially retentive, two-point engagement with said two tangentially spaced engagement surface areas, the resultant six-point engagement of said three corner-located means with said integral mask locating means effecting a tangentially rigid and precise coupling of said mask to said faceplate, said combination including means for holding said four mask corners on said faceplate when said tube is assembled.

* * * * *